United States Patent [19]

Garska et al.

[11] Patent Number: 4,490,568

[45] Date of Patent: Dec. 25, 1984

[54] CONVERSION OF CERTAIN HYDROCARBONS USING CALCINED TEA-SILICATE CATALYST

[75] Inventors: Daniel C. Garska, St. Albans, W. Va.; Edith M. Flanigen, White Plains, N.Y.

[73] Assignee: Union Carbide Corporation, Danbury, Conn.

[21] Appl. No.: 538,288

[22] Filed: Oct. 3, 1983

Related U.S. Application Data

[63] Continuation-in-part of Ser. No. 373,729, Apr. 30, 1982, abandoned.

[51] Int. Cl.[3] ..... C07C 3/10

[52] U.S. Cl. ..... 585/415; 585/419; 585/433; 585/434; 585/319

[58] Field of Search ..... 585/413, 415, 417, 418, 585/419, 433, 434

[56] References Cited

U.S. PATENT DOCUMENTS

| | | | |
|---|---|---|---|
| 3,832,449 | 8/1974 | Rosinski et al. | 502/71 |
| 3,970,544 | 7/1976 | Rosinski et al. | 502/71 |
| 4,061,724 | 12/1977 | Grose et al. | 502/71 |
| 4,104,294 | 8/1978 | Grose et al. | 502/71 |
| 4,157,293 | 6/1979 | Plank et al. | 585/415 |

FOREIGN PATENT DOCUMENTS

| | | | |
|---|---|---|---|
| 35807 | 9/1981 | European Pat. Off. | 585/415 |

*Primary Examiner*—Delbert E. Gantz
*Assistant Examiner*—A. Pal
*Attorney, Agent, or Firm*—David Fink

[57] ABSTRACT

By-product effluent streams from pyrolytic hydrocarbon cracking processes, containing monoolefins and diolefins, are treated to hydrogenate the olefins and to aromatize the aliphatics, with a catalyst essentially comprising a calcined TEA-silicate.

10 Claims, No Drawings

CONVERSION OF CERTAIN HYDROCARBONS USING CALCINED TEA-SILICATE CATALYST

CROSS REFERENCE TO RELATED PATENTS

This application is a continuation-in-part of Ser. No. 373,729 filed 04/30/82, now abandoned.

This application is related to Ser. No. 373,728, filed concurrently herewith and to Ser. No. 373,727, also filed concurrently herewith.

BACKGROUND OF THE INVENTION

1. Field of the Invention

This invention relates to the preparation of streams containing recoverable benzene, toluene, and xylenes ("BTX") from initial by-product effluent streams that contain other components, notably monoolefins and diolefins. In one aspect, the invention concerns the removal by conversion of these other components which ordinarily prevent recovery by distillation or solvent extraction of benzene-toluene-xylenes aromatics from the streams. In another aspect, it concerns a low severity process for treating the by-product streams with a specified catalyst, and under defined reaction conditions, both to produce benzene-toluene-xylenes from the initial stream and to reduce or eliminate those components that otherwise would interfere with the economic recovery of these aromatics from the streams.

2. Description of Prior Art

The preparation of light olefins and diolefins, mainly ethylene, propylene, and butadiene, by the thermal pyrolysis, or cracking, of petroleum fractions is well known and widely practiced. (See for example, Kirk & Othmer's "Encyclopedia of Chemical Technology", Second Edition, Vol. 8, pp. 503–514.) In these pyrolitic cracking processes, hydrocarbons ranging from ethane, through LPG (liquefied petroleum gas, chiefly propane with a few percent butanes), naphtha, heavy gas oil, to even crude petroleum oil, are subjected to high temperature conditions, at low pressure and for a short time, to produce a maximum of the desired product. These thermal processes vary widely, and the yields from any one process depend not only on process equipment and conditions, but on such extraneous factors as the presence or absence of diluents and other reactants, e.g., oxygen, hydrogen, steam, etc.

Even the best of the pyrolitic processes is less than ideally selective. As a consequence, the total reactor effluent will contain not only the desired olefin or diolefin, but a variety of other components, ranging from methane gas to high boiling polycyclic hydrocarbons. These by-products are conventionally separated, usually by distillation and/or absorption, so as to concentrate the main desired products for ultimate recovery, and to produce one or more by-product effluent streams.

The by-product effluents contain a mixture of hydrocarbon types, including paraffins, monoolefins, diolefins, aromatics, cyclics, and various substituted and polynuclear aromatics. Unless the by-product effluent stream or streams contains a particularly valuable or desirable component, making removal economical, the by-product effluent streams are of only limited utility. The lighter gases are useful only as fuel, while the heavier, normally liquid, components usually termed "dripolene," if not hydrogenated and then subjected to BTX extraction, are customarily either burned locally as fuel or else hydrogenated to saturate the unstable diolefins, and then blended with other gasoline fractions as motor fuel.

It has long been recognized that some of these by-product effluent streams, particularly the dripolene fractions, contain potentially valuable benzene, toluene, and xylenes (including ethylbenzene). Unfortunately, they also contain diolefins and monoolefins, which effectively interfere with most existing solvent extraction processes, such as the Udex and Sulfolane processes, for the extraction of aromatics from paraffins. Some of these olefins have boiling points similar to those of the BTX aromatics, and hence cannot be removed by fractional distillation. Selective hydrogenation to saturate the olefins and diolefins is practiced, and widely so, but the process tends to be expensive. Moreover, the diolefins in dripolene tend to be thermally unstable, forming catalyst-deactivating and exchanger-fouling carbonaceous deposits.

A variety of catalysts has been proposed for treating one or more of the by-product effluents from pyrolitic cracking processes so as to render the streams more valuable or more amenable to subsequent processing. (A tabulation of representative references identifying many of these processes, and many catalysts having conceivably useful activity for these processes, is appended.)

It is an object of the present invention to provide a process for preparing a stream from which benzene-toluene-xylenes may be recovered, by catalytically treating by-product effluent streams from pyrolytic hydrocarbon cracking processes. A further object is to provide a process for treating such by-product effluent stream in a simplified, low severity, operation so as both to produce benzene-toluene-xylenes (BTX), and, simultaneously, to decrease the content of interfering components. Still another object is to remove those monolefins and diolefins which have heretofore interfered with the solvent extraction of BTX from dripolene and the like.

SUMMARY OF THE INVENTION

Briefly, in accordance with the invention, a stream from which benzene, toluene, and xylenes may be recovered readily is prepared by contacting a pyrolitic hydrocarbon cracking by-product effluent stream, containing substantial amounts of interfering monolefins and diolefins, calcined with a TEA-silicate molecular sieve catalyst under low severity hydrocarbon processing conditions. As a result of this treatment, not only are the olefins hydrogenated to non-interfering aliphatics, but a substantial fraction of the aliphatics is dehydrocyclized to benzene-toluene-xylenes.

One of the remarkable aspects of the invention is that the same low severity conditions of temperature, pressure, and space velocity, which are suitable for hydrogenation with a TEA-silicate catalyst, are also suitable for the dehydrogenation reaction involved in aromatization. Thus, a simple processing scheme, with only a single reactor stage, is often adequate both to reduce to a minimal content, or eliminate the olefinic constituents that would interfere with the economic recovery of aromatics, and to produce benzene-toluene-xylenes from the feed stream.

A further important advantage of the invention resides in its ability to process any of a variety of the by-product effluent streams from pyrolitic cracking processes. As set out more fully below, these by-product effluent streams customarily include a $C_4$ fraction composed predominantly of butanes, butenes, and butadiene; a $C_5$ fraction composed mainly of pentanes, pentenes, pentadienes and cyclic $C_5$ compounds; a $C_6$–$C_8$ "dripolene" fraction containing BTX aromatics together with interfering olefins (i.e., having a similar boiling range); and a $C_9$-plus fraction, including some BTX along with higher alkylated benzenes and polynuclear aromatics and aliphatics. Each of these streams, plus others that may be present in a particular plant may be processes according to the invention.

The calcined TEA-silicate catalyst for use with the present invention, to be identified more fully below, is described in Grose et al. U.S. Pat. No. 4,104,294. It is believed to be isostructural with zeolite ZSM-12; see Rosinski et al. U.S. Pat. No. 3,832,449. TEA-silicates are crystalline metal organosilicates having identifiable X-ray diffraction characteristics and other properties that have been described in the reference above.

Various other aspects of the invention are set out below.

DESCRIPTION OF PREFERRED EMBODIMENTS

1. Pyrolitic Cracking Processes

Pyrolitic cracking processes for the preparation of light olefins and diolefins such as ethylene, propylene, and/or butadiene, have been described in the literature, and accordingly no detailed exposition is called for here.

In essence, the thermal pyrolysis, or cracking, of petroleum fractions may utilize as feed stocks hydrocarbons such as ethane, LPG (liquefied petroleum gas, chiefly propane with a few percent butanes), naphtha, heavy gas oil, or crude petroleum oil. These are subjected to controlled high temperature, low pressure, short time, pyrolitic cracking to produce the desired product or products. Thereafter the reactor effluent is subjected to a combination of condensation, fractional distillation, absorption, and perhaps other unit operations, to segregate various effluent streams enriched in one or more desirable components. The precise arrangement of product recovery streams forms no part of the present invention, and indeed it is probable that no two pyrolitic cracking plants utilize the same recovery scheme.

For example, the reactor effluent liquid may be subjected to fractional distillation to separate one or more fractions rich in benzene (B.P. 80.103° C.), toluene (B.P. 110.623° C.), and/or the xylenes, namely ethylbenzene (B.P. 136.187° C.), p-xylene (B.P. 139.348° C.), m-xylene (B.P. 139.102° C.), and o-xylene (B.P. 144.414° C.). This fraction, or fractions is desirably solvent extracted, as for example by the Undex or Solfolane process, to recover the BTX aromatic/aromatics.

In the absence of prior treatment, such as by the process of the present invention, solvent extraction is ineffective to extract the aromatics from the remaining aliphatics, inasmuch as solvents selective for aromatics will also extract many olefins and diolefins. However, the diolefins and the aromatics cannot be separated by fractional distillation; for example, benzene, with a boiling point of 80.103° C., is not easily distilled from the 2,4-hexadienes, which boil at about 80.0° C. Similarly, the various dimethylpentenes boil within a range of 72.2° C. to 85.0° C.

Be that as it may, and howsoever produced or constituted, there inevitably will be one or more by-product effluent streams which contain diverse mixtures of hydrocarbon (and perhaps non-hydrocarbon) components, varying both with respect to boiling point and chemical classification. It is this diversity that either complicates or prevents the recovery of useable components.

By way of example, in an illustrative pyrolitic cracking plant, the total reactor effluent may be segregated into a predominantly gaseous fraction including recoverable ethylene and propylene; a crude $C_4$ fraction, a distillation cut which includes hydrocarbons with primarily four carbon atoms each; a crude $C_5$ fraction, another distillation cut which primarily contains hydrocarbon molecules with five carbon atoms each, and generally containing a large quantity of unsaturated and cyclic compounds, including olefins and lesser amounts of $C_4$'s and lighter $C_6$'s and heavier; a $C_6$–$C_8$ fraction, sometimes referred to as pyrolysis gasoline or dripolene; and a $C_9$ plus fraction, a heavier distillation cut which primarily includes hydrocarbons with at least nine carbon atoms, along with lesser amounts of $C_5$–$C_8$ hydrocarbons. The $C_9$ fraction generally is produced as the distillation bottoms from the processing of dripolene to remove pyrolysis gasoline, and contains components as widely varying as styrene, ethyltoluenes, and trimethylbenzenes, to heavier compounds including ethylnaphthalene, diphenyl, and dimethylnaphthalene.

An illustrative $C_4$ fraction, giving both the range and a typical composition, is set out in Table I below:

TABLE I

| Illustrative $C_4$'s Composition | | |
|---|---|---|
| Compound | Observed Range | Typical Composition |
| Lights | 0.4–5.0 wt. % | 1.1 |
| Methylacetylene, Propadiene | 0.1–1.0 | 0.7 |
| n & i-Butane | 2.4–15.0 | 3.8 |
| 1-Butene and Isobutylene | 20.0–39.0 | 33.8 |
| t-2-Butene | 4.0–7.0 | 5.7 |
| c-2-Butene | 3.0–5.0 | 4.5 |
| 1,3-Butadiene | 41.0–54.0 | 44.6 |
| Vinylacetylene | 0.4–1.5 | 0.7 |
| Ethylacetylene | 0.1–0.5 | 0.2 |
| $C_{5+}$ | 0.2–5.0 | 4.1 |

Illustrative $C_5$ compositions, from two different plants, "A" and "B," are likewise represented in Table II below:

TABLE II

| Illustrative $C_5$'s Compositions | | | | |
|---|---|---|---|---|
| | Plant A | | Plant B | |
| | Observed Range | Typical Composition | Observed Range | Typical Composition |
| $C_4$ and Lighter | 0–1.5 wt. % | 0.7 | 1.4–8.1 | 5.5 |
| n & i-Pentanes | 0.14.4 | 7.2 | 17.3–44.60 | 23.6 |
| $C_5$ Olefins | 0.1–11.3 | 4.6 | 6.6–37.4 | 9.9 |
| Pentadienes | 9.7–35.3 | 20.0 | 3.5–12.9 | 4.2 |
| Isoprene | 2.4–43.0 | 13.1 | 5.0–16.8 | 5.9 |
| Cyclopentane | 1.6–7.5 | 3.2 | 0–2.0 | — |
| Cyclopentene | 2.2–10.3 | 5.4 | 2.0–14.4 | 2.3 |
| Cyclopentadiene | 0.60–2.8 | 1.4 | 1.0–20.6 | 4.6 |
| $C_6$ Paraffins | 1.1–7.2 | 4.2 | 1.3–10.5 | 10.1 |
| $C_6$ Olefins | — | — | 0.3.0 | 0.2 |
| Benzene | 0.4–5.1 | 1.3 | 0–23.8 | 23.8 |
| Dicyclopentadiene | 19.3–48.1 | 32.1 | 1.0–21.0 | 1.8 |
| Other $C_{6+}$ | 1.5–14.8 | 6.8 | 0.9.0 | 8.1 |

Illustrative $C_9$ compositions, again from Plant "A" and Plant "B", are described in Table III below:

TABLE III

| | Illustrative $C_9$'s Compositions | | | |
|---|---|---|---|---|
| | Plant A | | Plant B | |
| | Observed Range | Typical Composition | Observed Range | Typical Composition |
| $C_5$–$C_8$ | | | | |
| Nonaromatics | 0.5–5.4 | 0.5 | 0.2–3.4 | 0.2 |
| BTX | 0–9.8 | 1.7 | 0–31.9 | 1.2 |
| Styrene | 0.3–10.0 | 1.8 | 0.16.8 | 5.0 |
| Dicyclopentadiene | 7.2–40.0 | 29.2 | 4.7–42.0 | 40.5 |
| Methyl dicyclopentadiene and Dimethyldicyclopentadiene | 4.4–21.2 | 4.4 | 0–6.5 | 1.6 |
| Methyl Styrenes | 2.3–19.0 | 6.8 | 0.15.0 | 3.6 |
| $C_3$ Benzenes | 8.0–26.0 | 12.7 | 0–12.5 | 7.3 |
| Indane | 0.2–16.9 | 13.8 | 0–6.9 | 0.2 |
| Indene | 3.9–15.6 | 9.9 | 1.0–13.0 | 9.8 |
| Naphthalenes | 0.6–9.3 | 3.5 | 3.0–15.0 | 14.1 |
| Other $C_{10+}$ | 10.7–32.6 | 15.7 | 14.6–48.6 | 16.7 |

It will be appreciated, as noted earlier, that these compositions may vary quite widely, depending upon the initial feed to the pyrolitic cracking unit, the type of pyrolitic cracking unit, conditions, in the pyrolitic unit, and the type and conditions of the product recovery section. The by-product effluent streams may likewise be blended with each other where this is desired, or may include recycle components from elsewhere in the product recovery section.

2. Catalyst

The catalyst used in the present process in commonly termed calcined TEA-silicate, a newly discovered crystalline silica polymorph described in Grose et al. U.S. Pat. No. 4,104,294.

The class of crystalline metal organosilicates are synthesized from reaction systems essentially free of aluminum-containing reagents and are either entirely free of framework $AlO_4$-tetrahedra or contain no crystallographically significant amounts thereof. These compositions, as a class, are called TEA-silicates and have the following as-synthesized composition in terms of moles of oxides:

$$R_2O{:}0\text{–}1.5M_2O{:}<0.05Al_2O_3{:}40\text{–}70SiO_2{:}xH_2O$$

wherein R represents the tetraethylammonium cation, M represents an alkali metal cation, and x has a value of from 0 to 15 depending upon the degree of hydration of the composition. TEA-silicates possess a definite crystal structure whose X-ray powder diffraction pattern shows the following significant lines:

TABLE IV

| Interplanar Spacing d-(A) | Relative Intensity |
|---|---|
| 11:9 ± 0.2 | S |
| 10.2 ± 0.2 | M |
| 4.76 ± 0.1 | W |
| 4.29 ± 0.08 | VS |
| 3.87 ± 0.07 | VS |

These values were determined by standard techniques. The radiation was the K-alpha doublet of copper, and a scintillation-couter spectrometer with a strip-chart pen recorded was used. The peak heights "I" and the positions as a function of 2 times theta, where theta is the Bragg angle, were read from the spectrometer chart. From these, the relative intensities 100 I/Io, where Io is the intensity of the strongest line or peak and d (obs.), the interplanar spacing in A corresponding to the recorded lines, were calculated. In Table IV the relative intensities are given in terms of the symbols S=strong, M=medium, W=weak and VS=very strong. It should be understood that this X-ray diffraction pattern is characteristic of all the forms of TEA-silicate.

Using the process disclosed in the aforementioned Grose et al U.S. Pat. No. 4,104,294, the TEA-silicates can be produced so that the as-synthesized composition in terms of moles of oxides is:

$$R_2O{:}0\text{–}1.5M_2O{:}<0.05Al_2O_3{:}10\text{–}70SiO_2{:}xH_2O$$

wherein R represents the tetraethylammonium cation, M represents an alkali metal cation, and x has a value of from 0 to 15 depending upon the degree of hydration of the composition.

The crystalline metal organosilicates can be suitably synthesized by preparing a reaction system which in terms of moles of oxides has a composition within the range:

$$R_2O{:}0\text{–}8.0M_2O{:}12\text{–}40SiO_2{:}100\text{–}500H_2O,$$

wherein R represents the tetraethylammonium cation and M represents an alkali metal cation, preferably sodium, potassium or lithium, said reaction mixture being a pH of greater than 12. The reaction mixture is preferably formed from the hydroxide of the alkali metal employed and the tetraethylammonium cation can be provided from an appropriate salt or base thereof such as tetraethylammonium bromide and tetraethylammonium hydroxide. Any reactive source of $SiO_2$ such as silica sols, gels, solid amorphous silicas or alkali metal silicates can be utilized in the same manner as $SiO_2$ is conventionally supplied to reaction mixtures in the preparation of synthetic zeolites. The reaction system is maintained at a temperature within the range of 125° to 150° C. until crystals of TEA-silicate are formed, usually a period of from about 70 to 250 hours. Thereafter the crystals are separated from the mother liquor and recovered by filtration or other conventional means. After washing with water, the TEA-silicate crystals are dried either in vacuum or an inert atmosphere such as air at moderate temperatuers, about 100°–110° C.

The crystalline organosilicates described herein are substantially free of alumina, but may contain very minor amounts thereof due to the presence of alumina as an impurity in the reactants employed, principally the silica source. Accordingly, the molar ratio of alumina to silica will be in the range of zero to less than 0.005.

Neither the tetraethylammonium nor the alkali metal cations of the TEA-silicates can be removed by ion-exchange techniques. The organic cations, however, can be decomposed thermally by calcination at temperatures of 400° C. or higher in an oxidizing or inert atmosphere such as air or nitrogen, respectively. Thermal decomposition of the organic cations does not affect the essential crystalline structure of the composition and the X-ray powder diffraction pattern is essentially unaltered.

Calcination to thermally decompose the TEA cations produces an apparent pore diameter of greater than 6.2 Angstroms. Thereafter, the calcined TEA-silicate is desirably washed to remove any metals or trace contaminants.

When used in the present process, calcined TEA-silicate may be employed either alone or in intimate admixture with independently active catalyst components, as for example the noble metals such as platinum, or other catalytically active metals such as molybdenum, vanadium, zinc, etc. The techniques of introducing catalytically active metals to a molecular sieve zeolite are disclosed in the literature, and preexisting metal incorporation techniques are suitable. See, for example, Rabo et al. U.S. Pat. Nos. 3,236,761 and 3,236,762.

The physical form of the calcined TEA-silicate catalyst depends on the type of catalytic reactor being employed. Calcined TEA-silicate by itself is a fine-grain granule or powder, and is desirably compacted into a more readily usable form (e.g., larger agglomerates), usually with a silica or alumina binder for fluidized bed reaction, or pills, prills, spheres, extrudates, or other shapes of controlled size to accord adequate catalyst-reactant contact. As indicated, the catalyst may be employed either as a fluidized catalyst, or in a fixed or moving bed, and in one or more reaction stages.

3. Conversion Parameters

An unusual, if not unique, feature of the present invention is that the reaction conditions are low severity as compared with many preexisting processes. Indeed, the conversion parameters, while broad, may be selected to provide a high degree of versatility, depending upon the feed composition and on the desired product quality.

With respect to temperature, a temperature within the range of about 300°–700° C., more preferably within the range of about 350°–600° C., is adequate for many, if not all, conversions. Higher temperatures give more rapid and more complete reaction, but tend to produce undesirable by-products, chiefly coke, and may otherwise disturb the optimum balance of product composition with on-stream ease of operation.

The pressure, almost uniquely, is desirably quite low. Atmospheric pressure operation has been used successfully in the laboratory, but under specific conditions may be as high as 100 atmospheres or more. A desirable range is from atmospheric pressure to about 7 atmospheres. High pressures facilitate hydrogenation; lower pressures facilitate dehydrocyclization. The optimum pressure will therefore depend on process economics, considering whether it is more desirable to hydrogenate olefins than to produce a high yield of BTX aromatics.

Process stream flow rate, as expressed in units of weight hourly space velocity (WHSV), or weight of hydrocarbon feed per unit weight of catalyst, is suitably within the range of about 0.1 to about 20, more desirably about 0.5–5.0. High WHSV's permit more economic plant construction, while lower WHSV's permit more complete reaction at given temperature-pressure conditions.

If desired, a gaseous or gasifiable diluent may be introduced along with the hydrocarbon feed to the silicalite catalyst. This diluent may be inert, typified by steam, nitrogen or a low boiling paraffin, or may be reactive with the feed under catalysis conditions (e.g., hydrogen). Hydrogen is particularly desirable as it minimizes coke formation and deposition on the catalyst, with resulting premature deactivation, and also facilitates hydrogenation. As demonstrated below, however, the technique of the present invention need not utilize hydrogen.

If either an inert or a reactive gas is employed, diluent/hydrocarbon molar (gas volume) ratios, optimally, of from 0.1 to about 10 may be employed.

It is usually necessary that the catalyst be regenerated, either periodically or continously, to remove the carbonaceous coke-like deposits from the catalyst. In a fluidized bed operation, a portion of the catalyst is continuously withdrawn from the reactor and then subjected to regeneration by combustion with air or other oxygen containing gas, after which it is continuously recycled to the reactor. In a moving bed operation, the removal of catalyst followed by regeneration may be effected either continuously or periodically. In a fixed bed operation, it is generally desirable that two or more reactors be used in parallel, so that when one is processing the hydrocarbon feed, tne other is out of service and being regenerated. Regeneration conditions of approximately 450°–650° C., preferably 500°–600° C. may be employed.

4. Example I

A specific example for the conversion of a $C_9$-plus feed is presented below. From the data, it is apparent that olefins and diolefins are converted by hydrogenation; that acyclic and cyclic nonaromatic components are dehydrocyclized to aromatic compounds; that $C_9$ plus alkybenzenes, indan, indene, and methylstyrenes are converted in substantial part to the more desirable $C_6$–$C_8$ aromatics; and that, apparently, higher alkylnaphthalenes are converted by hydrogenolysis to recoverable naphthalene and methyl naphthalenes. Additionally, it is likely that the organic sulfur and nitrogen contents are lowered.

In the example herein, a $C_9$ plus by-product hydrocarbon effluent from the thermal pyrolysis unit was reacted over 37 g of 1/16 inch extrudates of TEA-silicate with a 15% alumina binder. The reaction vessel was a ¾ inch OD stainless steel tubular reactor.

The reaction pressure was ambient; the reaction temperature was approximately 450° C.; and the space velocity of the feed varied from 0.7–0.8 g feed/g catalyst/hr. The molar ratio of $SiO_2$-to-$Al_2O_3$ in the catalyst was 377:1.

Samples of the liquid products, trapped in an ice water condenser, were taken after one hour and after six hours on stream. Five gas product samples were taken periodically.

The feed had the following analysis:

Analysis of $C_9$-Plus Hydrocarbon Feed

| Compounds | Weight Percent |
|---|---|
| $C_5$–$C_8$ Nonaromatics | 0.19 |
| Benzene | 0.31 |
| Toluene | 0.10 |
| Ethylbenzene, Mixed Xylenes | 0.80 |
| Dicyclopentadiene, Styrene | 45.46 |
| $C_9$ Alkylbenzenes, Methylstyrenes | 10.61 |
| Indan | 0.21 |
| Indene | 9.83 |
| Naphthalene | 12.67 |
| Methylnaphthalenes | 1.45 |
| Other $C_{9+}$ Hydrocarbons | 18.37 |

The gas samples were analyzed on a Hewlett Packard 5830A gas chromtograph equipped with a thermal conductivity detector. A forty foot stainless steel column with an OD of ⅛ inch packed with 20% tributylphosphate on 35/80 mesh Chromasorb P (acid washed) was used. The thermal conductivity detector temperature was set at 250° C., and the column temperature was ambient (approximately 20°–22° C.). Gas samples were injected into the column off-line, through an eight port gas switching valve, via a gas syringe. The sample gas volume was approximately 0.3 cc; the carrier gas rate was 30 cc/min of helium.

Liquid samples for both product and feed were analyzed on a Hewlett Packard 5730A gas chromatograph, using a 5705A thermal conductivity detector. A ten foot stainless steel column with an OD of ⅛ inch, packed with 15% Carbowax 20M on 40/60 mesh Chromasorb P (acid washed), was used. The detector temperature was set at 250° C. The column was maintained in an oven, with a temperature programmed from 55° C. to 190° C. at 4° C./min; the injector temperature was 250° C. A sample size of approximately 2 μl. was used, and the helium carrier gas rate was 30 cc/min.

The following yields were determined:

Product Analyses From Conversion of $C_{9+}$ Hydrocarbons Using TEA-Silicate

| Compounds | Product Composition (Weight Percent Yield) 1 hr. | 6 hr. |
|---|---|---|
| Methane | 8.8 | 0.3 |
| Ethane, Ethylene | 1.3 | 0.3 |
| Propane | 9.4 | 0.1 |
| Propylene | 0.0 | 0.1 |
| $C_4$'s | 9.9 | 0.7 |
| $C_5$ to $C_8$ Nonaromatics | 3.5 | 12.0 |
| Benzene | 13.4 | 3.1 |
| Toluene | 12.3 | 4.0 |
| Mixed Xylenes | 10.1 | 6.7 |
| $C_{9+}$ Hydrocarbons | 31.3 | 72.8 |

EXAMPLE II

A crude butadiene by-product hydrocarbon from an olefins production unit was reacted over 0.25 g of powdered catalyst (TEA-silicate) in a thermal chromatograph microreactor at 450° C. Crude butadiene flow rate was 5 cc/min at ambient pressure. The molar ratio of $SiO_2$-to-$Al_2O_3$ in the catalyst was 377:1. The reaction products were collected in a liquid nitrogen trap and then were allowed to purge into a gas chromatograph OV-101 column with a helium carrier gas. Analyses were run on both a flame detector and a thermal conductivity detector.

EXAMPLE III

The extrudate catalyst used in Example I was tested in the microreactor for the conversion of crude butadiene by-product. All conditions and the amount of catalyst were the same as in Example II.

Analyses of the crude butadiene feed in Examples II and III, and of the products from the reactions are shown below:

Analysis of Crude Butadiene Feed

| Compounds | Weight Percent |
|---|---|
| $C_3$'s and lighter | 1.24 |
| Isobutane | 2.57 |
| n-Butane | 8.68 |
| 1-Butene, Isobutylene | 33.74 |
| t-2-Butene | 4.15 |
| c-2-Butene | 2.44 |
| 1,3-Butadiene | 45.72 |
| $C_4$ Acetylenes | 1.28 |
| $C_5$ Hydrocarbons | 0.19 |

Product Analyses From Conversion of Crude Butadiene Using TEA-Silicate Catalyst

-continued

| Compounds | Example II | Example III |
|---|---|---|
| $C_1$-$C_4$ | 32.5 | 38.2 |
| $C_5$ + $C_6$ Aliphatics | 9.5 | 8.1 |
| Benzene | 3.9 | 3.3 |
| $C_7$ Aliphatics | 3.8 | 4.7 |
| Toluene | 11.4 | 7.6 |
| $C_8$ Aliphatics | 3.1 | 6.3 |
| Ethylbenzene, Xylenes | 14.3 | 11.3 |
| $C_{9+}$ Hydrocarbons | 21.5 | 20.7 |

Thus it is apparent that there has been provided, according to the invention, a process that is uniquely effective in treating by-product effluent streams from pyrolytic cracking processes.

References

Mobil Oil U.S. Pat. No. 3,442,795
Mobil Oil U.S. Pat. No. 3,702,886
Mobil Oil U.S. Pat. No. 3,728,408
Mobile Oil U.S. Pat. No. 3,760,024
Mobil Oil U.S. Pat. No. 3,790,471
Mobil Oil U.S. Pat. No. 3,813,330
Mobil Oil U.S. Pat. No. 3,970,544
Mobil Oil U.S. Pat. No. 4,097,367
Mobil Oil U.S. Pat. No. 4,105,541
Mobil Oil U.S. Pat. No. 4,120,910
Mobil Oil U.S. Pat. No. 4,150,006
Mobil Oil U.S. Pat. No. 4,150,062
Mobil Oil U.S. Pat. No. 4,157,293
Mobil Oil European Patent Application No. 15,132
Mobil Oil European Patent Application No. 23,089
Mobil Oil European Patent Application No. 26,030
Shell Internationale Research Maatschappij, U.K. Patent Application No. 2,044,289
Shell Internationale Research Maatschappij, U.K. Patent Application No. 2,044,290
Shell Internationale Research Maatschappij, NL Pat. No. 7,902,019
Shell Internationale Research Maatschappij, NL Patent Application No. 8,001,342
Union Carbide U.S. Pat. No. 3,444,253
Union Carbide U.S. Pat. No. 3,497,462
Union Carbide U.S. Pat. No. 4,061,724
Union Carbide U.S. Pat. No. 4,170,571
Union Carbide U.S. Pat. No. 4,257,885
Erdolchemie Ger. Offen. DE No. 2,936,036 B.P. Belg. Patent No. 862,051

We claim:

1. A low severity process for the preparation of a benzene-toluene-xylenes enriched stream containing minimal monoolefin and diolefin content, from a feed stream comprising a by-product effluent of a process for the pyrolitic cracking of hydrocarbons to produce light olefins or diolefins, said by-product effluent stream containing olefins and diolefins, said process comprising contacting said by-product effluent stream, under low severity conditions including a temperature within the range of about 300°-700° C., a pressure within the range of about 0 to 100 atmospheres, and a weight hourly space velocity within the range of about 0.1 to about 20, with a catalyst essentially comprising a calcined TEA-silicate.

2. Process of claim 1 wherein said conditions include a temperature within the range of about 350°-600° C., a pressure within the range of about 0-7 atmospheres, and a weight hourly space velocity within the range of about 0.5-5.0.

3. Process of claim 1 wherein said by-product effluent comprises a $C_4$ stream.

4. Process of claim 1 wherein said by-product effluent comprises a $C_5$ stream.

5. Process of claim 1 wherein said by-product effluent comprises a whole or fractionated dripolene stream.

6. Process of claim 1 wherein said feed stream is admixed with a diluent.

7. Process of claim 6 wherein said diluent is steam.

8. Process of claim 6 wherein said diluent is hydrogen.

9. Process of claim 6 wherein said diluent is a low boiling paraffin.

10. Process of claim 6 wherein said diluent is a mixture of a low boiling paraffin, hydrogen and/or steam.

* * * * *

UNITED STATES PATENT AND TRADEMARK OFFICE

CERTIFICATE OF CORRECTION

PATENT NO. : 4,490,568

DATED : December 25, 1984

INVENTOR(S) : Daniel C. Garska and Edith M. Flanigen

It is certified that error appears in the above-identified patent and that said Letters Patent is hereby corrected as shown below:

Col. 5, line 25, delete "," after "conditions".
Col. 5, line 33, change "in" in the second instance to --is--.
Col. 5, line 59, the last part of Table IV is missing. Insert the following after line 59:

| | | |
|---|---|---|
| -- | 3.66 ± 0.07 | W |
| | 3.49 ± 0.07 | W |
| | 3.38 ± 0.07 | M |
| | 3.20 ± 0.06 | W |
| | 3.05 ± 0.05 | W |
| | 2.64 ± 0.03 | W -- |

Col. 8, line 62, change "chromtograph" to --chromatograph--.
Col. 9, line 53, change "Analyses" to --Analysis--.
Col. 10, line 21, change "Mobile" to --Mobil--.

Signed and Sealed this

*Twenty-second* Day of *October 1985*

[SEAL]

*Attest:*

*Attesting Officer*

DONALD J. QUIGG

*Commissioner of Patents and Trademarks—Designate*